US008932711B2

(12) United States Patent
Aso et al.

(10) Patent No.: US 8,932,711 B2
(45) Date of Patent: Jan. 13, 2015

(54) OIL AGENT COMPOSITION FOR ACRYLIC PRECURSOR FIBERS FOR CARBON FIBERS, ACRYLIC PRECURSOR FIBER BUNDLE FOR CARBON FIBERS, AND METHOD FOR PRODUCING THE SAME

(75) Inventors: Hiromi Aso, Hiroshima (JP); Naoki Sugiura, Aichi (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 902 days.

(21) Appl. No.: 12/741,763

(22) PCT Filed: Nov. 4, 2008

(86) PCT No.: PCT/JP2008/070055

§ 371 (c)(1),
(2), (4) Date: May 6, 2010

(87) PCT Pub. No.: WO2009/060834

PCT Pub. Date: May 14, 2009

(65) Prior Publication Data

US 2010/0247911 A1 Sep. 30, 2010

(30) Foreign Application Priority Data

Nov. 7, 2007 (JP) ..... 2007-289409
Dec. 10, 2007 (JP) ..... 2007-318439
Dec. 10, 2007 (JP) ..... 2007-318440

(51) Int. Cl.

*B32B 9/00* (2006.01)
*B32B 25/20* (2006.01)
*D06M 15/647* (2006.01)
*D06M 13/00* (2006.01)
*D06M 101/28* (2006.01)

(52) U.S. Cl.

CPC ..... *D06M 15/647* (2013.01); *D06M 7/00* (2013.01); *C10M 2207/14* (2013.01); *C10M 2209/103* (2013.01); *C10M 2209/109* (2013.01); *C10M 2229/041* (2013.01); *C10M 2229/045* (2013.01); *C10M 2229/046* (2013.01); *C10M 2229/047* (2013.01); *C10M 2229/052* (2013.01); *C10N 2220/082* (2013.01); *C10N 2230/24* (2013.01); *C10N 2240/62* (2013.01); *D06M 2101/28* (2013.01); *D06M 2200/40* (2013.01)

USPC ..... 428/391; 252/8.84

(58) Field of Classification Search

None

See application file for complete search history.

(56) References Cited

U.S. PATENT DOCUMENTS 4,431,789 A 2/1984 Okazaki et al.
4,603,042 A 7/1986 Setsuie et al.
5,599,778 A * 2/1997 Ishikawa et al. ..... 508/208
6,407,274 B1 * 6/2002 Vrckovnik et al. ..... 556/422
2005/0142079 A1 * 6/2005 Garrison et al. ..... 424/59
2006/0239948 A1 * 10/2006 LaVay et al. ..... 424/70.7
2007/0071980 A1 3/2007 Kemei et al.
2008/0152574 A1 6/2008 Tanaka et al.
2009/0041817 A1 2/2009 Takakura et al.
2009/0263576 A1 10/2009 Okabe et al.

FOREIGN PATENT DOCUMENTS

JP 57 149290 9/1982
JP 58 5287 1/1983
JP 60 43446 9/1985
JP 60 181323 9/1985
JP 61 15186 4/1986
JP 63 36365 7/1988
JP 63 203878 8/1988
JP 2 19232 5/1990
JP 4 33891 6/1992
JP 9 78340 3/1997
JP 11 12855 1/1999
JP 2000 199183 7/2000
JP 2001058926 A * 3/2001
JP 2001 123382 5/2001
JP 2001123382 A * 5/2001
JP 2001 172879 6/2001
JP 2003 55881 2/2003
JP 2003 253567 9/2003
JP 2003 278084 10/2003
JP 3481342 12/2003
JP 2005 264384 9/2005
JP 2007 39866 2/2007
WO WO 2007/066517 A1 6/2007
WO WO 2007066517 A1 * 6/2007
WO WO 2007/097274 A1 8/2007

OTHER PUBLICATIONS

Tachibana, K., Powder Composition and Powder in Oil Dispersion and Cosmetic Comprises the Same, Mar. 6, 2001, machine translation of JP2001-058926.*

(Continued)

*Primary Examiner* — Alicia Chevalier
*Assistant Examiner* — Chinessa Adkins
(74) *Attorney, Agent, or Firm* — Oblon, Spivak, McClelland, Maier & Neustadt, L.L.P.

(57) ABSTRACT

An object of the present invention is to provide an oil agent composition which can improve the reduction in operability occurring when an oil agent composition containing a silicone compound is used as the main component and the reduction in the physical properties of the carbon fiber bundle occurring when a non-silicone-based oil agent composition is used. The oil agent composition for acrylic precursor fibers for carbon fibers of the present invention contains 1 to 10 wt % of a modified polydimethylsiloxane including a unit having a specific alkyl chain, at least one unit selected from the group consisting of a unit having a specific polyethylene oxide chain, a unit having a specific polyglycerin chain, and a unit having a specific polyether chain, and optionally a unit having a specific polydimethylsiloxyalkyl chain.

18 Claims, No Drawings

(56) References Cited

OTHER PUBLICATIONS

Komatsu, Y. et al., Agent for Treating Synthetic Fiber for Production of Carbon Fiber, May 8, 2001, machine translation of JP2001-123382.*

Okabe et at., Oil Solution for Acrylic Fiber for Use in the Manufacture of Carbon Fiber, and Method for Manufacture of Carbon Fiber Using the Same, Jun. 14, 2007, machine translation of WO2007066517.*

Extended European Search Report issued Jan. 16, 2012, in European Patent Application No. 08846535.6.

* cited by examiner

OIL AGENT COMPOSITION FOR ACRYLIC PRECURSOR FIBERS FOR CARBON FIBERS, ACRYLIC PRECURSOR FIBER BUNDLE FOR CARBON FIBERS, AND METHOD FOR PRODUCING THE SAME

This application is a 371 of PCT/JP08/70055 filed Nov. 4, 2008. Priority to

Japanese patent application 2007-289409, filed Nov. 7, 2007; Japanese patent application 2007-318439, filed Dec. 10, 2007; and Japanese patent application 2007-318440, filed Dec. 10, 2007, is claimed.

TECHNICAL FIELD

The present invention relates to an oil agent composition for acrylic precursor fibers for carbon fibers (hereinafter also denoted simply as an oil agent composition) used for preventing the fusion between single fibers which occurs in a stabilization step of converting a acrylic precursor fiber bundle for carbon fibers (hereinafter also denoted simply as a precursor fiber bundle) into a stabilized fiber bundle in a production process of a carbon fiber bundle. In addition, the present invention also relates to acrylic precursor fibers for carbon fibers suitable for producing carbon fibers which are excellent in quality and physical properties and have improved stability in stabilization and carbonization steps, and a method for producing the same.

BACKGROUND ART

There has been known a method for producing a carbon fiber bundle including heat-treating a precursor fiber bundle in an oxygen atmosphere at 200 to 400° C. to convert it into a stabilized fiber bundle followed by carbonizing the stabilized fiber bundle in an inert atmosphere at 1000° C. or higher to obtain the carbon fiber bundle. The carbon fiber bundle obtained by this method is widely used industrially, particularly as a reinforcement fiber for composite materials, owing to excellent mechanical properties thereof.

However, fusion may occur between single fibers in the stabilization step of converting the precursor fiber bundle into a stabilized fiber bundle, wherein the fusion may cause process failure such as fluffing and bundle breakage in the stabilization step and the subsequent carbonization step (hereinafter, the stabilization step and the carbonization step may be integrated and denoted also as a heating step). It is known that selection of an oil agent to be adhered to the precursor fiber bundle is important to avoid this fusion, and a large number of oil agent compositions have been studied. For example, a silicone-based oil agent in which an amino-modified silicone, an epoxy-modified silicone, a polyether-modified silicone or the like is blended is frequently used as an oil agent composition because it has high heat resistance and effectively suppresses fusion (for example, Patent Document 1).

However, for such a silicone-based oil agent mainly composed of a silicone compound having the effect of preventing the fusion between single fibers, the silicone component undergoes a crosslinking reaction upon heating, resulting in an increase in viscosity. As a result, a viscous material derived therefrom may accumulate on the surfaces of fiber transporting rollers and guides in the production process of the precursor fiber bundle and in the stabilization step, and a fiber bundle may be wound around or got caught in these rollers and guides to result in thread breakage, thereby leading to reduction in operability. Moreover, the oil agent composition containing a silicone compound may have such a problem that it produces silicon compounds such as silicon oxide, silicon carbide and silicon nitride in the heating step, and the scale thereof reduces the stability of the heating step and the quality of a product.

For this reason, a non-silicone-based oil agent using a non-silicone component as the main component of an oil agent composition has been proposed for many years for improving the operability of the heating step. Examples of the non-silicone-based oil agent include a polybutene (refer to Patent Document 2), a blend of a polyoxyethylene higher aliphatic alkyl ether and an antioxidant (refer to Patent Document 3), a neopentyl alcohol derivative (refer to Patent Document 4), an alkyl or alkenyl thio fatty acid ester (refer to Patent Document 5), a polymeric amide compound (refer to Patent Document 6), an ammonium salt of a fatty acid ester (refer to Patent Document 7), a fluorochemical surfactant (refer to Patent Document 8), an aromatic composite ester and an amide compound (refer to Patent Document 9).

However, although a non-silicone-based oil agent has advantageous points such as no occurrence of silicon compounds in the heating step or use of an inexpensive raw material, it is often poorer in thermal stability than a silicone-based oil agent, which causes the occurrence of fluffing and bundle breakage due to the fusion in the heating step. In addition, since the mechanical properties of the produced carbon fiber bundle are also poorer than those in the case where a silicone-based oil agent is used, the opportunity of using a non-silicone-based oil agent as an oil agent composition for acrylic precursor fibers for carbon fibers was limited to a part of product classes.

On the other hand, there is proposed a technique for reducing silicon compounds derived from a silicone-based compound produced in the heating step by combining a silicone-based oil agent and a non-silicone-based oil agent (refer to Patent Documents 10 and 11). However, the technique has had a problem that the compatibility of a silicone compound with a non-silicone compound is low, and so it is impossible to uniformly adhere a mixture of the silicone compound and the non-silicone compound to the surface of the precursor fiber bundle. As a result, the effect of preventing the fusion between single fibers has been insufficient in the part in which the non-silicone compound is unevenly distributed, that is, in the part in which the silicone component is present in a small amount or is not substantially present, and it has been difficult to stably obtain a carbon fiber bundle excellent in mechanical properties.

Furthermore, there is proposed a technique for improving emulsification stability by adding an alkylene oxide-modified silicone to an oil agent containing a silicone and a non-silicone component (refer to Patent Documents 12 and 13). However, although an alkylene oxide-modified silicone has a certain effect to stabilize emulsification, the compatibilization effect of a silicone and a non-silicone component is not sufficient. As a result, adhesion of the oil agent component to the precursor fiber bundle is not uniform, and fusion between single fibers cannot be completely prevented. Therefore, it has been difficult to stably obtain a carbon fiber bundle excellent in mechanical properties.

As mentioned above, with respect to process stability and development of mechanical properties of a carbon fiber bundle, the use of only a non-silicone-based oil agent composition by related art tends to be poorer than the use of an oil agent composition using a silicone compound as the main component. Therefore, a high-quality carbon fiber bundle cannot be stably obtained. Further, when an oil agent composition having a reduced content of silicone compound is used, it is difficult to uniformly adhere the silicone compound and a non-silicone compound to the surface of the precursor fiber bundle. Therefore, a high-quality carbon fiber bundle cannot be stably obtained.

That is, the problem of the reduction in operability due to the production of silicon compounds in the heating step stemming from a silicone-based oil agent and the problem of the reduction in mechanical properties of the carbon fiber bundle due to a non-silicone-based oil agent are in an inextricably linked relation, and both of these problems have not been solved by related art.

Patent Document 1
JP11-12855A
Patent Document 2
JP58-5287B
Patent Document 3
JP60-43446B
Patent Document 4
JP04-33891B
Patent Document 5
JP61-15186B
Patent Document 6
JP3481342B
Patent Document 7
JP63-36365B
Patent Document 8
JP02-19232B
Patent Document 9
JP09-78340A
Patent Document 10
JP2000-199183A
Patent Document 11
JP2005-264384A
Patent Document 12
JP2003-55881A
Patent Document 13
JP2003-278084A

DISCLOSURE OF THE INVENTION

Problems to be Solved by the Invention

An object of the present invention is to provide an oil agent composition for acrylic precursor fibers for carbon fibers which can improve the reduction in operability occurring when an oil agent composition containing a silicone compound is used as the main component and the reduction in the physical properties of the carbon fiber bundle occurring when a non-silicone compound is used as the main component or a non-silicone-based oil agent composition is used mixed with a silicone compound. Another object of the present invention is to provide an acrylic precursor fiber bundle for carbon fibers which shows good step passableness through the heating step and can increase the industrial productivity of the carbon fiber bundle by adhering the above oil agent composition to the precursor fiber bundle, and to provide a method for producing the same.

Means for Solving the Problems

In the present invention, a specific modified silicone compound is used as one of the components of the oil agent composition as described below, as means for solving the above problems. This can provide a uniform aqueous emulsion in which a silicone compound and a non-silicone compound are compatibilized even when an oil agent composition prepared by mixing these components is used. Thus, there is provided an oil agent composition for acrylic precursor fibers for carbon fibers which can be uniformly applied to the precursor fiber bundle and can achieve both the stabilization of the heating step by reducing the content of a silicone compound and the development of high mechanical properties of a carbon fiber bundle.

The oil agent composition for acrylic precursor fibers for carbon fibers of the present invention contains 1 to 10 wt % of a modified polydimethylsiloxane including at least a unit represented by the formula (1):

[Formula 1]

(1)

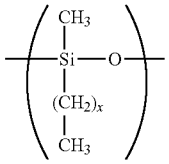

(wherein x is 7 to 15), at least one unit selected from the group consisting of a unit represented by the formula (2):

[Formula 2]

(2)

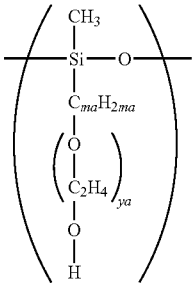

(wherein ma is 0 to 3; and ya is 5 to 15), a unit represented by the formula (3):

[Formula 3]

(3)

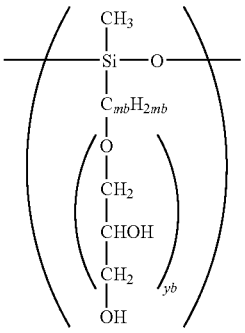

(wherein mb is 0 to 3; and yb is 1 to 5), and a unit represented by the formula (4):

[Formula 4]

(4)

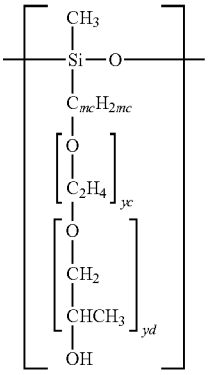

(wherein yc+yd is 5 to 15; ethylene oxide and propylene oxide each is a block copolymer or a random copolymer; and mc is 0 to 3), and optionally a unit represented by the formula (5):

[Formula 5]

(5)

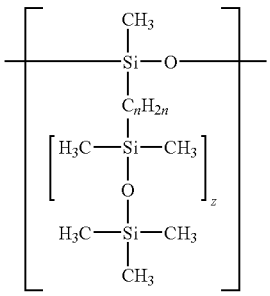

(wherein n is 1 to 5; and z is 3 to 60).

Preferably, the modified polydimethylsiloxane has the unit represented by each of the formulas (1), (2) and (5) in an amount of one or more and has a kinematic viscosity at 25° C. of 500 to 1000 $mm^2/s$.

Preferably, the modified polydimethylsiloxane has the unit represented by each of the formulas (1), (3) and (5) in an amount of 1 to 20 and has a kinematic viscosity at 25° C. of 3000 to 5000 $mm^2/s$.

Preferably, the modified polydimethylsiloxane has the unit represented by each of the formulas (1) and (4) in an amount of 1 to 20 and has a kinematic viscosity at 25° C. of 500 to 1500 $mm^2/s$.

The oil agent composition for acrylic precursor fibers for carbon fibers of the present invention preferably further contains a silicone compound and an organic compound not containing silicon.

The organic compound not containing silicon is preferably an aromatic ester.

The silicone compound is preferably an amino-modified silicone.

The oil agent composition for acrylic precursor fibers for carbon fibers of the present invention preferably contains 30 to 70 wt % of an aromatic ester and 10 to 50 wt % of am amino-modified silicone.

The oil agent composition for acrylic precursor fibers for carbon fibers of the present invention preferably contains 10 to 40 wt % of a nonionic emulsifier.

The oil agent for acrylic precursor fibers for carbon fibers of the present invention is prepared by dispersing the oil agent composition for acrylic precursor fibers for carbon fibers in water.

The acrylic precursor fiber bundle for carbon fibers of the present invention is prepared by applying the oil agent composition for acrylic precursor fibers for carbon fibers or the oil agent for acrylic precursor fibers for carbon fibers to the bundle in an amount of 0.1 to 2.0 wt % based on the mass of dry fiber.

The method for producing the acrylic precursor fiber bundle for carbon fibers of the present invention includes the steps of: applying an oil agent for acrylic precursor fibers for carbon fibers having an average micelle particle size of 0.01 μm or more and 0.5 μm or less to an acrylic precursor fiber bundle for carbon fibers so that the oil agent is applied in an amount in the specified range; and drying and densifying the fiber to which the oil agent has been applied.

Advantages of the Invention

The present invention can effectively suppress the fusion between single fibers in the production process of a carbon fiber bundle and can also suppress the production of silicon compounds which may cause process failure to a lower level than before. This improves operability and can provide an oil agent composition for acrylic precursor fibers for carbon fibers capable of exhibiting better mechanical properties than conventional products. Also provided are an oil agent with the oil agent composition dispersed in water, an acrylic precursor fiber bundle for carbon fibers to which the oil agent is applied, and a method for producing the bundle.

BEST MODE FOR CARRYING OUT THE INVENTION

The present inventors have intensively investigated an oil agent composition which contains a reduced amount of silicone and by which a carbon fiber bundle can exhibit excellent mechanical properties, the carbon fiber bundle being obtained by adhering the oil agent composition to an acrylic fiber bundle and heating the resulting precursor fiber bundle. As a result, the present inventors have found an oil agent composition which solves both the problems of reduction in the silicone content and improvement in carbon fiber bundle strength by using a modified polydimethylsiloxane having a specific unit. That is, the present invention has made it possible to simultaneously improve the operability of production processes and the quality of products.

In the present invention, an acrylic fiber bundle spun by known art can be used as the acrylic fiber bundle before adhering an oil agent composition thereto.

Examples of a preferred acrylic fiber bundle include an acrylic fiber bundle obtained by spinning an acrylonitrile-based polymer.

The acrylonitrile-based polymer is a polymer obtained by using acrylonitrile as the main monomer and polymerizing the monomer. The acrylonitrile-based polymer may be not only a homopolymer obtained only from acrylonitrile but also an acrylonitrile-based copolymer in which other monomers are used in addition to acrylonitrile which is the main component.

The content of the acrylonitrile unit in the acrylonitrile-based copolymer is more preferably 96.0 to 98.5 wt % from the viewpoint of preventing the thermal fusion of fibers in the heating step, the heat resistance of the copolymer, the stability of a spinning dope and the quality of the resulting carbon fibers. The acrylonitrile unit of 96 wt % or more is preferred, in that fibers are not liable to be thermally fused in the heating step where the fibers are converted to carbon fibers, and excellent quality and performance of carbon fiber can be maintained. Further, since the heat resistance of the copolymer itself is not low, the adhesion between single fibers can be avoided in the step such as drying or drawing by heating rollers or pressurized steam of precursor fibers, in the spinning of the fibers. On the other hand, the acrylonitrile unit of 98.5 wt % or less is preferred, in that the solubility of the copolymer into a solvent is not reduced; the stability of the spinning dope can be maintained; the precipitation and coagulation properties of the copolymer are not increased; and stable production of the precursor fiber is achieved.

When a copolymer is used, a monomer other than acrylonitrile is suitably selected from vinyl monomers that can be copolymerized with acrylonitrile. For example, such a monomer is preferably selected from monomers having the effect of promoting stabilization reaction such as acrylic acid, methacrylic acid, itaconic acid, and an alkali metal salt or an ammonium salt thereof, and acrylamide because these monomers can promote stabilizing. As a vinyl monomer that can be copolymerized with acrylonitrile, a carboxyl group-containing vinyl monomer such as acrylic acid, methacrylic acid, and itaconic acid is more preferred. The content of the carboxyl group-containing vinyl monomer unit in the acrylonitrile-based copolymer is preferably 0.5 to 2.0 wt %. One or more other monomers may be employed.

In the case of spinning, the acrylonitrile-based polymer is dissolved in a solvent to prepare a spinning dope. The solvent for preparing the spinning dope can be suitably selected and used from known solvents such as organic solvents such as dimethylacetamide, dimethyl sulfoxide, and dimethylformamide and aqueous solutions of an inorganic compound such as zinc chloride and sodium thiocyanate. Dimethylacetamide, dimethyl sulfoxide, and dimethylformamide that have a fast rate of coagulation are preferred from the viewpoint of productivity improvement, dimethylacetamide being more preferred.

In order to obtain a dense coagulated-yarn in this case, it is preferred to prepare a spinning dope so that the polymer concentration of the spinning dope may be increased to some extent. Specifically, the polymer concentration in the spinning dope is preferably 17 wt % or more, more preferably 19 wt % or more. In addition, since the spinning dope requires proper viscosity and fluidity, the polymer concentration is preferably in the range not exceeding 25 wt %.

As the spinning method, known spinning methods can be employed such as a wet spinning method in which the above spinning dope is directly spun into a coagulation bath, a dry spinning method in which the spinning dope is coagulated in the air, and a dry-wet spinning method in which the spinning dope is once spun in the air and then coagulated in a bath. For obtaining a carbon fiber bundle having higher performance, a wet spinning method or a dry-wet spinning method is preferred.

Spinning and shaping by a wet spinning method or a dry-wet spinning method can be performed by spinning the above spinning dope into a coagulation bath from a nozzle having a hole with a circular section. An aqueous solution containing a solvent used for the above spinning dope is preferably used as the coagulation bath from the viewpoint of the ease of solvent recovery.

When an aqueous solution containing a solvent is used as a coagulation bath, the concentration of the solvent in the aqueous solution is preferably 50 to 85 wt % because this concentration can form a dense structure without voids to provide a high-performance carbon fiber bundle, can ensure drawability, and is excellent in productivity. The temperature of the coagulation bath is preferably 10 to 60° C.

A polymer or a copolymer is dissolved in a solvent to form a spinning dope, which is discharged into a coagulation bath to form a fiber. Then, the coagulated fiber can be subjected to drawing in a bath, in which it is drawn in a coagulation bath or in a drawing bath. Alternatively, part of the coagulated fiber may be drawn in the air followed by drawing in a bath, and may be washed with water before or after drawing or simultaneously with drawing to obtain a fiber in a water-swollen state. Generally, the drawing in a bath is preferably performed in a water bath of 50 to 98° C. once or in multiple stages divided into two or more times, and a total draw ratio of the drawing in the air and the drawing in a bath of 2 to 10 times is preferred in terms of the performance of the resulting carbon fiber bundle.

The oil agent composition can be applied to the acrylic fiber bundle by applying an emulsion of the oil agent composition to the acrylic fiber bundle in a water-swollen state after the above-mentioned drawing in a bath. When the acrylic fiber bundle is washed after the drawing in a bath, the emulsion of the oil agent composition can also be applied to the fiber bundle in a water-swollen state obtained after the bundle is subjected to drawing in a bath and washing.

The oil agent composition for acrylic precursor fibers for carbon fibers according to the present invention contains 1 to 10 wt % of a modified polydimethylsiloxane including at least a unit represented by the formula (1), at least one unit selected from the group consisting of units represented by the formulas (2), (3) and (4), and optionally a unit represented by the formula (5).

The oil agent composition for acrylic precursor fibers for carbon fibers according to the present invention contains 1 to 10 wt % of the modified polydimethylsiloxane. The content of 1 wt % or more is sufficient to compatibilize each component of the oil agent composition, and the content of 10 wt % or less can completely prevent the fusion between the single fibers in the heating step and prevents silicon compounds from increasing in the heating step to reduce operability. The modified polydimethylsiloxane is preferably contained in an amount of 3 to 5 wt %.

Preferably, the modified polydimethylsiloxane has the unit represented by each of the formulas (1), (2) and (5) in an amount of one or more and has a kinematic viscosity at 25° C. of 500 to 1000 $mm^2/s$ (hereinafter, referred to as a modified polydimethylsiloxane 1).

The alkyl chain is well compatible with oil and fat, and the effect of this part allows the modified polydimethylsiloxane 1 to be dissolved in both silicone and an ester compound, thus exhibiting the compatibilization effect. In the formula (1), x of the alkyl chain is 7 to 15. Preferably, x is 11. When x is 7 or more, the modified polydimethylsiloxane 1 has good solubility in oil and fat, and when x is 15 or less, good stability is obtained when the oil agent composition is dispersed in water.

The polyethylene oxide chain is well compatible with water and works to stabilize micelle when the oil agent composition is dispersed in water. In the formula (2), the number of ethylene oxide of the polyethylene oxide chain (ya) is 5 to 15. Preferably, ya is 9. When ya is 5 or more, the modified polydimethylsiloxane 1 has good compatibility with water, and the resulting emulsion will have good stability. In addition, thermal stability is good when ya is 15 or less. Further, an alkyl group defined by ma of 0 to 3 may be present between polyethylene oxide and polydimethylsiloxane. Preferably, ma is 0. When ma is 3 or less, the modified polydimethylsiloxane 1 has good dispersibility in water, and the stability of the resulting emulsion will not be reduced.

The modified polydimethylsiloxane 1 has a high solubility in silicone when a polydimethylsiloxyalkyl chain is contained. The alkyl part of the polydimethylsiloxyalkyl chain is a saturated hydrocarbon in which n is 1 to 5 in the formula (5). Preferably, n is 2. When n is 5 or less, the modified polydimethylsiloxane 1 has well-balanced solubility in an aromatic ester and silicone, thus exhibiting the compatibilization effect. The length of the polydimethylsiloxy part is determined by the total balance. Specifically, z in the formula (5) is in the range of 3 to 60, which is a value by which the modified polydimethylsiloxane 1 has a kinematic viscosity at 25° C. ranging from 500 to 1000 $mm^2/s$. Preferably, z is 5 to 30. When the value of z is 3 or more, the modified polydimethylsiloxane 1 has good solubility in silicone, exhibiting the compatibilization effect. When the value of z is 60 or less, the modified polydimethylsiloxane 1 does not have too high solubility in silicone, resulting in well-balanced compatibilization.

Moreover, each of the number of units of the formulas (1), (2) and (5) are preferably in the range of 2 to 5. If the number of units is within this range, each performance mentioned above for respective units is well-balanced, leading to good compatibilization ability. When the unit shown in each of the formulas (1), (2) and (5) is present in an amount of two or more, the values of x, ya, z, ma, and n may be the same or different according to each of the units.

The modified polydimethylsiloxane 1 preferably has a kinematic viscosity of 500 to 1000 $mm^2/s$ at 25° C., more preferably 600 to 800 $mm^2/s$. When the kinematic viscosity is 500 $mm^2/s$ or more, the molecular weight is not too small, which allows the polyethylene oxide chain and alkyl chain to be uniformly introduced into a structure and improves thermal stability. When the kinematic viscosity is 1000 $mm^2/s$ or less, the oil agent is easily emulsified and the resulting emulsion will have good stability. In addition, a highly viscous material does not precipitate on the drying rolls in the drying step after the oil agent is applied to the precursor fiber bundle to reduce the operability. Note that the kinematic viscosity at 25° C. can be measured with the Ubbelohde viscometer according to ASTM D 445-46T.

Preferably, the modified polydimethylsiloxane has the unit represented by each of the formula (1), (3) and (5) in an amount of 1 to 20 and has a kinematic viscosity at 25° C. of 3000 to 5000 $mm^2/s$ (hereinafter, referred to as a modified polydimethylsiloxane 2).

The alkyl chain is well compatible with oil and fat, and the effect of this part allows the modified polydimethylsiloxane 2 to be dissolved in both silicone and an ester compound, thus exhibiting the compatibilization effect. In the formula (1), x of the alkyl chain is 7 to 15. Preferably, x is 11. When x is less than 7, the solubility of the modified polydimethylsiloxane 2 in oil and fat is reduced, and when x is more than 15, the stability will be reduced when the oil agent composition is dispersed in water.

The polyglycerin chain is well compatible with water and works to stabilize micelle when the oil agent composition is dispersed in water. In the formula (3), yb of the polyglycerin chain is 1 to 5. Preferably, yb is 3. When yb is less than 1, the modified polydimethylsiloxane 2 has poor compatibility with water, and the resulting emulsion will have a reduced stability. Thermal stability will be reduced when yb is greater than 5. Further, alkyl defined by mb of 0 to 3 may be present between polyglycerin oxide and polydimethylsiloxane. Preferably, mb is 0. When mb exceeds 3, the modified polydimethylsiloxane 2 will have a reduced dispersibility in water, and the stability of the resulting emulsion will be reduced.

The modified polydimethylsiloxane 2 has a high solubility in silicone when the polydimethylsiloxyalkyl chain is contained. The alkyl part of the polydimethylsiloxyalkyl chain is a saturated hydrocarbon, wherein n is 1 to 5 in the formula (5). Preferably, n is 2. When n is more than 5, the modified polydimethylsiloxane 2 will have poorly balanced solubility in an aromatic ester and silicone, leading to reduction in the compatibilization effect. The length of the polydimethylsiloxy part is determined by the total balance. Specifically, z in the formula (5) is in the range of 3 to 60, which is a value by which the modified polydimethylsiloxane 2 has a kinematic viscosity ranging from 3000 to 5000 $mm^2/s$. Preferably, z is 5 to 30. When the value of z is less than 3, the modified polydimethylsiloxane 2 will have a reduced solubility in silicone, leading to reduction in the compatibilization effect. When the value of z exceeds 60, the modified polydimethylsiloxane 2 will have high solubility in silicone, leading to reduction in the balance of compatibilization.

The modified polydimethylsiloxane 2 preferably has a kinematic viscosity of 3000 to 5000 $mm^2/s$ at 25° C., more preferably 3500 to 4500 $mm^2/s$. When the kinematic viscosity is less than 3000 $mm^2/s$, the molecular weight will be necessarily low, which prevents the polyglycerin chain and alkyl chain from being uniformly introduced into a structure and reduces thermal stability. When the kinematic viscosity is more than 5000 $mm^2/s$, the oil agent will be hardly emulsified and the resulting emulsion will have a reduced stability. In addition, a highly viscous material will precipitate on the drying rolls in the drying step after the oil agent is applied to the precursor fiber bundle to reduce the operability.

The modified polydimethylsiloxane 2 has the unit of each of the formulas (1), (3) and (5) in an amount of 1 to 20. Preferably, the number of units is 2 to 5. If the number of units is within this range, the balance between the respective units will be good, leading to good compatibilization ability which is a target. When the unit shown in each of the formulas (1), (3) and (5) is present in an amount of two or more, the values of x, yb, z, mb, and n may be the same or different according to the respective units. In addition, the unit represented by formula (6) may be contained:

[Formula 6]

(6)

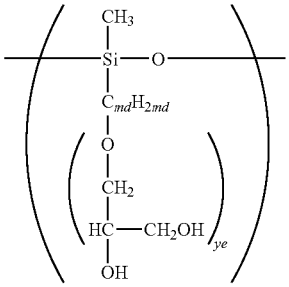

wherein, and ye are any integers.

Preferably, the modified polydimethylsiloxane has the unit represented by each of the formula (1) and (4) in an amount of 1 to 20 and has a kinematic viscosity at 25° C. of 500 to 1500 $mm^2/s$ (hereinafter, referred to as a modified polydimethylsiloxane 3).

The alkyl chain is well compatible with oil and fat, and the effect of this part allows the modified polydimethylsiloxane 3 to be dissolved in both silicone and an ester compound, thus exhibiting the compatibilization effect.

In the formula (1), x of the alkyl chain is 7 to 15. Preferably, x is 9 to 13. When x is less than 7, the solubility of the modified polydimethylsiloxane 3 in oil and fat is reduced, and when x is more than 15, the stability will be reduced when the oil agent composition is dispersed in water.

The polyether chain is well compatible with water and works to stabilize micelle when the oil agent composition is dispersed in water. In the formula (4), the number of ethylene oxide and propylene oxide (yc+yd) of the polyether chain is in the range of 5 to 15. Preferably, yc+yd is 8 to 12. When yc+yd is less than 5, the modified polydimethylsiloxane 3 has poor compatibility with water, and the resulting emulsion will have a reduced stability. Thermal stability will be reduced when yc+yd is greater than 15. Further, alkyl defined by mc of 0 to 3 may be present between the polyether chain and polydimethylsiloxane. Preferably, mc is 0. When mc exceeds 3, the modified polydimethylsiloxane 3 will have a reduced dispersibility in water, and the stability of the resulting emulsion will be reduced.

The modified polydimethylsiloxane 3 preferably has a kinematic viscosity of 500 to 1500 $mm^2/s$ at 25° C., more preferably 800 to 1200 $mm^2/s$. When the kinematic viscosity is less than 500 $mm^2/s$, the molecular weight will be necessarily low, which prevents the polyether chain and alkyl chain from being uniformly introduced into a structure and reduces thermal stability. When the kinematic viscosity is more than 1500 $mm^2/s$, the oil agent will be hardly emulsified and the resulting emulsion will have a reduced stability. In addition, a highly viscous material will precipitate on the drying rolls in the drying step after the oil agent is applied to the precursor fiber bundle to reduce the operability.

The modified polydimethylsiloxane 3 has the unit of each of the formulas (1) and (4) in an amount of 1 to 20. Preferably, the number of units is 2 to 5. If the number of units is within this range, the balance between the respective units will be good, leading to good compatibilization ability which is a target. When the unit shown in each of the formulas (1) and (4) is present in an amount of two or more, the values of x, yc, yd, and mc may be the same or different according to the respective units.

In the present invention, the oil agent composition preferably contains a silicone compound and an organic compound which does not contain silicon. More preferably, the silicone compound is an amino-modified silicone, and the organic compound which does not contain silicon is an aromatic ester. Further, it is preferred that the content of the amino-modified silicone is in the range of from 10 to 50 wt %, and the content of the aromatic ester is in the range of from 30 to 70 wt %. More preferably, the content of the amino-modified silicone is 30 to 50 wt % and the content of the aromatic ester is 30 to 50 wt %. Further preferably, the content of the amino-modified silicone is 30 to 40 wt % and the content of the aromatic ester is 30 to 40 wt %.

When the content of the aromatic ester is 30 wt % or more, the aromatic ester is well-balanced with the amino-modified silicone, which allows the oil agent composition to be uniformly adhered to the acrylic fiber bundle, and the carbon fiber bundle obtained by heating the precursor fiber bundle to which the oil agent has been adhered will exhibit stable physical properties. Moreover, when the content of the aromatic ester is 70 wt % or less, the content of the amino-modified silicone is not too low, which improves bundling properties in the spinning step, and the carbon fiber bundle obtained by heating the precursor fiber bundle to which the oil agent has been adhered will exhibit excellent mechanical properties.

When the content of the amino-modified silicone is 10 wt % or more, the bundling properties in the spinning step can be sufficiently maintained; the oil agent has high heat resistance; and the fusion between single fibers in the heating step can be completely prevented. Further, when the content of the amino-modified silicone is 50 wt % or less, the silicon compound produced and scattered in the heating step can be suppressed, which does not cause reduction in operability and the quality of produced carbon fibers.

The aromatic ester used for the oil agent composition of the present invention is not particularly limited. Examples of the aromatic ester include benzoates, salicylates, phthalates, trimellitates, pyromellitic acid esters, and ethylene oxide or propylene oxide adducts of bisphenol A esterified with higher fatty acids at both ends. The aromatic ester preferably has a weight reduction ratio at 300° C. of 1 wt % or less in the thermogravimetric analysis measured while increasing the temperature at 5° C./min from room temperature in the presence of steam. Examples of such an aromatic ester include trimellitate having an alkyl chain part having 12 to 16 carbon atoms.

The amino-modified silicone used for the oil agent composition of the present invention is not particularly limited. The amino-modified silicone may be any of a primary side chain amino-modified type, a primary and secondary side chain amine-modified type, and a both-end amino-modified type. The amino-modified silicone preferably has a primary side chain amine structure, a kinematic viscosity at 25° C. of 1000 to 5000 $mm^2/s$, and an amino equivalent of 4000 to 6000 g/mol.

The emulsifier used for the oil agent composition of the present invention is preferably a nonionic emulsifier. Examples of the nonionic emulsifier include ethylene oxide addition-type nonionic surfactants such as higher alcohol ethylene oxide adducts, alkylphenol ethylene oxide adducts, aliphatic ethylene oxide adducts, polyhydric alcohol aliphatic ester ethylene oxide adducts, higher alkylamine ethylene oxide adducts, aliphatic amide ethylene oxide adducts, ethylene oxide adducts of fats and oils, and copolymers of polyethylene oxide and polypropylene oxide; and polyhydric alcohol-based nonionic surfactants such as aliphatic esters of glycerol, aliphatic esters of pentaerythritol, aliphatic esters of sorbitol, aliphatic esters of sorbitan, aliphatic esters of sucrose, alkyl ethers of polyhydric alcohols, and fatty amides of alkanolamines. Block copolymers of polyethylene oxide (EO) and polypropylene oxide (PO) are more preferred. The content of the nonionic emulsifier is preferably 10 to 40 wt %, more preferably 10 to 20 wt %. When the content of the nonionic emulsifier is 10 wt % or more, the oil agent is easily emulsified, and the resulting emulsion has high stability. When the content of the nonionic emulsifier is 40 wt % or less, the content of the aromatic ester or silicone can be within the preferred range as described above. Thereby, the adhesion in the precursor fiber bundle becomes uniform, and the fusion between single fibers can be prevented.

In the present invention, the oil agent composition containing the modified polydimethylsiloxane is adhered to the acrylic fiber bundle in a water-swollen state. Generally, an aqueous emulsion with the oil agent composition dispersed in water is applied to the acrylic fiber bundle in a water-swollen state. It is preferable to use an oil agent composition prepared by blending the above-described aromatic ester, amino-modified silicone, and nonionic emulsifier in the above-described percentages.

The emulsion containing the modified polydimethylsiloxane, aromatic ester, amino-modified silicone, and nonionic emulsifier can be prepared, for example, as described below. The modified polydimethylsiloxane is mixed with the aromatic ester under stirring, and the amino-modified silicone is added to the mixture with stirring. To the resulting mixture, an emulsifier and water is added to obtain an emulsion with an oil agent composition dispersed in water. Each component can be mixed or dispersed in water using a propeller-type stirrer, a homomixer, a homogenizer, or the like. In particular, when an amino-modified silicone having high viscosity is used, it is preferable to use an ultra high pressure homogenizer which can be pressurized to 150 MPa or more.

Note that the oil agent composition may optionally contain an antioxidant in the present invention as necessary. Various known antioxidants can be used, but a phenolic antioxidant and a sulfur-based antioxidant are preferred. Specific examples of the phenolic antioxidant include 2,6-di-t-butyl-p-cresol, 4,4'-butylidenebis-(6-t-butyl-3-methyl phenol), 2,2'-methylenebis-(4-methyl-6-t-butylphenol), 2,2'-methylenebis-(4-ethyl-6-t-butylphenol), 2,6-di-t-butyl-4-ethylphenol, 1,1,3-tris(2-methyl-4-hydroxy-5-t-butylphenyl)butane, n-octadecyl-3-(3,5-di-t-butyl-4-hydroxyphenyl)propionate, tetrakis[methylene-3-(3,5-di-t-butyl-4-hydroxyphenyl)propionate]methane, triethylene glycol bis[3-(3-t-butyl-4-hydroxy-5-methylphenyl)propionate], and tris(3,5-di-t-butyl-4-hydroxybenzyl)isocyanurate. Examples of the sulfur-based antioxidant include dilauryl thiodipropionate, distearyl thiodipropionate, dimyristyl thiodipropionate, and ditridecyl thiodipropionate. The antioxidant may be used independently or may be used as a mixture of a plurality of antioxidants.

Moreover, an antioxidant that dissolves in a selected aromatic ester is more preferably used. The main reason for the above is that the aromatic ester is the oil agent component on which the antioxidant is expected to act more; and the antioxidant is conveniently dissolved in the aromatic ester beforehand as a method to uniformly mix the antioxidant with the oil agent.

In the present invention, the oil agent composition optionally contains an antistatic agent for improving the properties thereof. Known materials can be used as the antistatic agent. The antistatic agent is classified into an ionic and a nonionic antistatic agent. The ionic antistatic agent includes an anionic, a cationic, and an amphoteric antistatic agent, and the nonionic antistatic agent includes a polyethylene glycol-type and a polyhydric alcohol-type antistatic agent. From the viewpoint of antistaticity, the ionic antistatic agent is preferred, and examples include aliphatic sulfonates, higher alcohol sulfates, higher alcohol ethylene oxide adduct sulfates, higher alcohol phosphates, higher alcohol ethylene oxide adduct sulfate-phosphates, quaternary ammonium salt-type cationic surfactants, betaine-type amphoteric surfactants, higher alcohol ethylene oxide adduct polyethylene glycol fatty acid esters, and polyhydric alcohol fatty acid esters. These may be used independently or in combination.

In addition, in order to improve the process stability and the stability and adhesion characteristics of the oil agent composition, additives such as a defoaming agent, an antiseptic agent, an antibacterial agent, and a penetrant may be suitably blended with the oil agent composition in the present invention depending on the equipment and the service conditions for adhering the oil agent composition to the acrylic fiber bundle.

As a method for applying the oil agent composition of the present invention to the precursor fiber bundle in a water-swollen state, a technique is used in which ion exchange water is added to the emulsion in which the oil agent composition prepared by the method as described above is dispersed in water to thereby dilute the emulsion to a predetermined concentration to form an oil agent treatment solution, which is then adhered to the precursor fiber bundle in a water-swollen state.

As a method for adhering the oil agent treatment solution to the precursor fibers in a water-swollen state, there can be used known methods such as a roller adhesion method in which the lower part of a roller is immersed in an oil agent-applying solution and the precursor fiber bundle is brought into contact with the upper part of the roller; a guide adhesion method in which a certain amount of oil agent-applying solution is discharged from a guide through a pump and the precursor fiber bundle is brought into contact with the surface of the guide; a spray adhesion method in which a certain amount of oil agent-applying solution is sprayed from a nozzle to the precursor fiber bundle; and a dip adhesion method in which the precursor fiber bundle is immersed in an oil agent-applying solution and then squeezed with a roller or the like to remove excess oil agent-applying solution. From the viewpoint of uniform adhesion, preferred is a dip adhesion method in which the oil agent treatment solution is sufficiently permeated into the fiber bundle and excess treatment solution is removed. For more uniformly adhering the oil agent, it is effective to divide the oil agent-applying step into a multi-stage step having two or more stages to apply the oil agent repeatedly.

In the present invention, the adhesion amount of the oil agent composition to the acrylic fiber bundle is preferably 0.1 to 2.0 wt %, more preferably 0.5 to 1.5 wt %, based on the mass of dry fiber of the acrylic fiber bundle after dried and densified as will be described below. When the adhesion amount of the oil agent composition is lower than 0.1 wt %, it may be difficult to allow the original function of the oil agent to be sufficiently exhibited. On the other hand, when the adhesion amount of the oil agent composition is higher than 2.0 wt %, the excessively adhered oil agent composition may be polymerized in the heating step to induce the adhesion between single fibers.

In particular, in the case of producing the precursor fiber bundle in which the oil agent composition is adhered to the acrylic precursor fiber bundle for carbon fibers in an amount of 0.1 to 2.0 wt % based on the mass of dry fiber of the acrylic fiber bundle, it is preferable to prepare an 0/W type aqueous emulsion in which the oil agent composition forms micelle having an average particle size of 0.01 μm or more and 0.5 μm or less. This allows uniform application of the oil agent to the surface of the acrylic fiber bundle. Note that the average particle size of the micelle present in the O/W type aqueous emulsion can be measured based on Mie scattering theory using a laser diffraction/scatter type particle size distribution measuring instrument (trade name: "LA-910", manufactured by HORIBA, Ltd.).

In the present invention, the precursor fiber bundle to which the oil agent composition has been adhered is dried and densified in the subsequent drying step. It is necessary to perform the drying and densification at a temperature exceeding the glass transition temperature of the fiber, but the glass transition temperature is substantially different depending on the water content of the fiber from a water-containing state to a dry state. Therefore, it is preferable to perform the drying and densification by a method using a heating roller at a temperature of about 100 to 200° C. In this method, the number of heating rollers may be one or more.

The drying is preferably followed by pressurized steam drawing because the denseness and the degree of orientation of the resulting fiber can be further enhanced. The pressurized steam drawing is a method of drawing fibers in a pressurized steam atmosphere. Since this method allows a high-ratio drawing, it allows higher and more stable spinning and contributes to the improvement in the denseness and degree of orientation of the resulting fiber.

In the pressurized steam drawing in the present invention, it is preferable to control the temperature of the heating roller immediately before the pressurized steam drawing apparatus within a range from 120 to 190° C. and control the degree of variability of the vapor pressure in the pressurized steam drawing within 0.5% or less. This allows the variability of the draw ratio of the fiber bundle and the resulting variability of the tow fineness to be suppressed. If the temperature of the heating roller is less than 120° C., the temperature of the precursor fiber bundle will not be sufficiently high, resulting in reduction in the drawability of fiber.

The pressure of steam in the pressurized steam drawing is preferably 200 kPa·g or more (gauge pressure, the same shall apply hereinafter) so that the suppression of the drawing by the heating rollers and the feature of the pressurized steam drawing method appear clearly. It is preferable to suitably control the vapor pressure by keeping the balance with the treatment time. However, since steam leakage may be increased when high pressure is applied, the vapor pressure is preferably about 600 kPa·g or less.

The fiber bundle which has completed drying and densification is passed through rolls at room temperature, cooled to ordinary temperature, and then wound into a bobbin by a winder. Alternatively, the fiber bundle is transferred into a can and stored and then moved to the heating step.

The use of the oil agent composition for acrylic precursor fibers for carbon fibers of the present invention allows the fusion in the spinning step and the heating step to be suppressed and the carbon fiber bundle excellent in quality and physical properties to be produced. In addition, since the scattering of the silicone compound decomposition product in the heating step and the amount of silicon compounds produced are little, operability and step passableness are significantly improved. Thus, the oil agent composition according to the present invention has both the effects of improvement in stable production and carbon fiber physical properties. The carbon fiber bundle produced by properly applying the present oil agent composition to the precursor fiber bundle as described above is suitable as a reinforcement fiber used for the fiber reinforced resin composite material used for various structural materials.

EXAMPLES

Hereinafter, the present invention will be further specifically described with reference to Examples, but the oil agent composition for acrylic precursor fibers for carbon fibers of the present invention, the acrylic precursor fiber bundle for carbon fibers to which this oil agent composition has been adhered, and the method for producing the same are not limited to Examples. Note that the amount of adhered oil agent to the precursor fiber bundle, the bundling properties, the number of fusions between single fibers of the carbon fiber bundle obtained by heating the precursor fiber bundle, strand strength, and the scattering of silicon compounds derived from the silicone compound in the heating step were evaluated by the following methods.

(Amount of Adhered Oil Agent)

The precursor fiber bundle was dried at 105° C. for 1 hour and then immersed in methyl ethyl ketone at 90° C. for 8 hours to solvent-extract the oil agent composition adhered thereto. The masses of the acrylic precursor fiber bundle for carbon fibers before and after the extraction were precisely weighed, and the amount of adhered oil agent was determined from the difference of the masses.

(Evaluation of Bundling Properties)

The state of the precursor fiber bundle was observed on the last roll of the spinning step of the precursor fiber bundle, that is, the roll immediately before winding the precursor fiber bundle into a bobbin, and the bundling properties were evaluated in accordance with the following criteria.

○: Fibers are bundled to form a fiber bundle, which has a constant tow width and is not in contact with adjacent fiber bundles;

Δ: Fibers are bundled to form a fiber bundle, which has a tow width that is not constant or is wide; and x: There is space in a fiber bundle, showing that fibers are not bundled.

(The Number of Fusions Between Single Fibers (Number of Fusions))

A carbonized carbon fiber bundle was cut into 3 mm in length, dispersed in acetone, and stirred for 10 minutes. Then, the total number of single fibers and the number of fusions were counted, and the number of fusions per 100 single fibers was calculated for evaluation. The evaluation criteria are as follows.

○: Number of fusions (pieces/100 single fibers)≤1; and x: Number of fusions (pieces/100 single fibers)>1.

(Carbon Fiber Bundle Strand Strength (CF Strength))

The CF strength was measured in accordance with the epoxy resin-impregnated strand testing method as stipulated in JIS R-7601. Note that the measurement count was 10 times, and the average value was evaluated.

(Evaluation of the Scattering of Silicon Compounds Derived from Silicone Compounds)

With respect to the amount of scattered silicon compounds derived from the silicone compound in the stabilization step, the acrylic precursor fiber bundle for carbon fibers and the stabilized fiber bundle obtained by stabilizing the same were each measured for the content of Si element with an X-ray fluorescence analyzer and then the amount of Si scattered in the stabilization step was calculated from the difference between the measured values as an index of evaluation.

(The amount of Si scattered)=Si content of the precursor fiber bundle−Si content of stabilized fiber bundle (mg/kg)

"ZSX100e" (trade name, manufactured by Rigaku Corporation) was used as the X-ray fluorescence analyzer. The measuring sample was prepared by uniformly rolling fiber bundles on an acrylic resin sheet of 20 mm in length, 40 mm in width, and 5 mm in thickness leaving no space between the fiber bundles, and the sample was set in the analyzer. For preparing the sample, it is important to equalize the rolled length of the fiber bundles to be subjected to the measurement. Then, the intensity of X-ray fluorescence of Si was measured by conventional X-ray fluorescence analysis. From the resulting intensities of X-ray fluorescence of Si in the precursor fiber bundle and the stabilized fiber bundle, the Si content of each fiber bundle was determined using a calibration curve. The number of measurements n was 10, and the average value of them was used for evaluation.

Example a1

An emulsion of an oil agent composition was prepared in the following manner:

- Polyether alkyl co-modified silicone (a): lauryl PEG-9 polydimethylsiloxyethyl dimethicone (trade name: "KF-6038" manufactured by Shin-Etsu Chemical Co. Ltd., the number of units in the formula (1), (2) and (5) being 2 to 5, x=11, ya=9, ma=0, n=2, and z=5 to 30, having a kinematic viscosity at 25° C. of 700 $mm^2/s$);
- Aromatic ester (i): a trimellitate obtained by subjecting trimellitic acid and dodecyl alcohol to dehydration condensation;
- Amino-modified silicone (1): a primary side chain type amino-modified silicone having a kinematic viscosity of 4000 $mm^2/s$ (25° C.) and an amino equivalent of 6000 g/mol, obtained by an alkali equilibrium method which is a general synthetic method of an amino-modified silicone; and
- PO-EO copolymer: a block copolymer type polyether consisting of propylene oxide (PO) and ethylene oxide (EO) (trade name: "F-68", manufactured by ADEKA Corporation).

The above compounds were mixed at a mass ratio of 5:40:35:20 (polyether alkyl co-modified-silicone (a):aromatic ester (i):amino-modified silicone (1):PO-EO copolymer). To the above mixture was added ion exchange water so that the concentration of the oil agent composition might be 30 wt %, and the resulting mixture was emulsified by a homomixer. Since the average micelle particle size was about 2 μM in this state, the micelle was further dispersed to a particle size of 0.2 μm or less with a high-pressure homogenizer. The resulting emulsion was used as an undiluted oil agent solution in the following steps.

An acrylic fiber bundle to which the oil agent composition is to be adhered was prepared in the following manner. An acrylonitrile-based copolymer (composition ratio: acrylonitrile/acrylamide/methacrylic acid=96/3/1 (mass ratio)) was dissolved in dimethylacetamide to prepare a spinning dope. The spinning dope was discharged into a coagulation bath filled with an aqueous dimethylacetamide solution from a spinning nozzle having a pore size (diameter) of 75 μM and the number of holes of 6000 to obtain a coagulated yarn. The coagulated yarn was introduced into a water washing tank to remove the solvent and drawn 5 times the initial length to obtain an acrylic fiber bundle in a water-swollen state.

The acrylic fiber bundle in a water-swollen state was introduced into an oil agent treatment tank containing a treatment solution obtained by diluting the undiluted oil agent solution with ion exchange water to adhere the oil agent composition thereto. Then, the resulting acrylic fiber bundle was dried and densified with a drying roll having a surface temperature of 180° C. and then drawn 3 times the initial length with steam at a pressure of 0.2 MPa. The evaluation results of the bundling properties of the precursor fiber bundle obtained here are shown in Table 1. The precursor fiber bundle had good bundling properties and constant tow width as well.

This acrylic precursor fiber bundle for carbon fibers was passed through a stabilizing furnace having a temperature gradient of 220 to 260° C. and heated in a carbonization furnace having a temperature gradient of 400 to 1300° C. in a nitrogen atmosphere to form a carbon fiber bundle.

Table 1 shows the evaluation results of the number of fusions, the carbon fiber bundle strand strength (hereinafter, referred to also as CF strength), and the scattering of silicon compounds derived from silicone in the stabilization step for the carbon fiber bundle obtained here. The evaluation results of both the number of fusions and the scattering of silicon compounds were satisfactory, and the CF strength was also high.

Examples a2 to a10

Examples a2 to a10 were performed in the same manner as in Example a1 except that the type and the content of the components constituting the oil agent composition were changed. Note that a polyether alkyl co-modified silicone (a) and a PO-EO copolymer were the same materials as those used in Example a1. The ratio (percentage by mass) of each component in the oil agent composition in each Example is shown in Table 1.

As the aromatic ester (ii) in Table 1, polyoxyethylene bisphenol A dilaurate (trade name: "Exceparl BP-DL", manufactured by Kao Corporation) was used.

Further, as the amino-modified silicone (2) in Table 1, there was used a primary and secondary side chain amino-modified silicone (trade name: "DOW CORNING TORAY FZ-3785", manufactured by Dow Corning Toray Co., Ltd.) having a kinematic viscosity of 4000 $mm^2/s$ (25° C.) and an amino equivalent of 6000 g/mol. Further, as the amino-modified silicone (3), there was used a both-end amino-modified silicone (trade name: "KF-8008", manufactured by Shin-Etsu Chemical Co., Ltd.) having a kinematic viscosity of 450 $mm^2/s$ (25° C.) and an amino equivalent of 5700 g/mol.

Evaluation results of Examples a2 to a10 are shown in Table 1. In all of Examples a2 to a10, all of the evaluations of the bundling properties, the number of fusions, and the scattering of silicon compounds were satisfactory. In Example a8 in which the polyether alkyl co-modified silicone (a) was contained in an amount of 10 wt % and in Examples a9 and a10 in which the amino-modified silicone was contained in an amount of 20 wt % and 10 wt %, respectively, the bundling properties were a little poorer than in other Examples, but it was not to a degree that will cause a problem in the production process.

In the evaluation results of the strand strength, all results were satisfactory, but a difference is caused by the difference in the components of the oil agent composition and the difference in the mixing ratio. In the case where the content of the polyether alkyl co-modified silicone (a) is 1 wt % (Example a5) or 10 wt % (Example a8), the strand strength was a little lower than in the case where the content is 3 wt % or 5 wt %, but it was a sufficient strength.

Further, in the case where the amino-modified silicone is contained in an amount of 20 wt % (Example a9) or 10 wt % (Example a10), the strand strength was a little lower than in the case where the amino-modified silicone is contained in an amount of 30 to 50 wt %, but it was a sufficient strength.

With respect to the aromatic ester, both the trimellitate and polyoxyethylene bisphenol A dilaurate showed satisfactory results, but the trimellitate was better.

With respect to the amino-modified silicone, satisfactory results were obtained in all cases where any of the primary side chain amino-modified type, the primary and secondary side chain amine-modified type, and the both-end amino-modified type was used. Better result was obtained when the primary side chain amino-modified type was used.

Comparative Example a1

The precursor fiber bundle was produced and heated to form a carbon fiber bundle in the same manner as in Example a1 except that there was used an oil agent composition in which the polyether alkyl co-modified silicone (a) in Example a1 was replaced with a polyether-modified silicone (trade name: "KF-6011", manufactured by Shin-Etsu Chemical Co., Ltd.) having a structure represented by the following formula (7). The carbon fiber bundle was evaluated for various properties, and the results are shown in Table 2. Although the evaluation results of bundling properties and the scattering of silicon compounds were satisfactory, a large number of fusions were observed. As a result, it was expected that it would be difficult to continuously produce such a carbon fiber bundle industrially. Further, the strand strength was lower than that of the carbon fiber bundles in any of Examples a1 to a10.

[Formula 7]

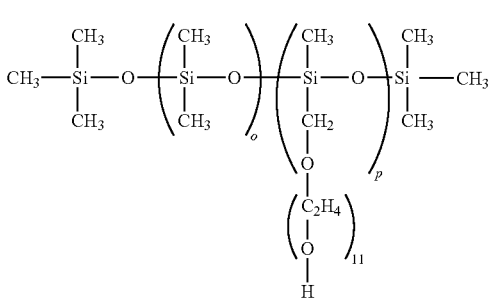

(7)

In formula (7), o is 60 to 100; and p is 2 to 10.

Comparative Examples a2 to a9

Comparative Examples a2 to a9 were performed in the same manner as in Example a1 except that the type and the content of the components constituting the oil agent composition were changed. Note that, in Comparative Example a2, an alkyl-modified silicone (trade name: "TSF4421", manufactured by Momentive Performance Materials Japan LLC) was used. Other materials were the same as those used in Example. The ratio (percentage by mass) of each component in the oil agent composition in each Comparative Example is shown in Table 2.

Evaluation results of Comparative Examples a2 to a9 are shown in Table 2. In the case where the polyether-modified silicone and the alkyl-modified silicone are used, it was impossible to completely prevent the fusion between single fibers, and the strand strength was lower than that in the case where the polyether alkyl co-modified silicone (a) was used. Further, in the case where the content of the polyether alkyl co-modified silicone (a) exceeds 10 wt % and the content of the amino-modified silicone is low (Comparative Examples a4 to a6), the bundling properties were low, which may have caused process failure.

Further, in the case where the content of the polyether alkyl co-modified silicone (a) exceeds 10 wt %; the content of the trimellitate is lower than 30 wt %; and the content of the amino-modified silicone exceeds 50 wt % (Comparative Example a3), the evaluation of the number of fusions and the evaluation results of the strand strength were relatively satisfactory, but the amount of scattered silicon compounds increased, leading to reduction in operability.

In the case where the content of the trimellitate exceeds 50 wt % and the content of the amino-modified silicone is lower than 30 wt % (Comparative Examples a5 and a9), it was impossible to completely prevent the fusion between single fibers, leading to reduction in strand strength.

Note that, in the case where the polyether alkyl co-modified silicone (a) is not blended (Comparative Example a7), the strand strength was lower than that in the case where the polyether alkyl co-modified silicone (a) was blended in substantially the same composition (Example a1).

Further, in the case where the amino-modified silicone is used as the main component (Comparative Example a8), the amount of the scattering of silicon compounds was large, leading to reduction in operability; and in the case where the amino-modified silicone is not contained at all (Comparative Example a9), the bundling properties were low; the number of fusions was high; and the strand strength was low as well.

Examples b1 to b8

Examples b1 to b8 were performed in the same manner as in Examples a1 to a10 except that lauryl polyglyceryl-3 polydimethylsiloxyethyl dimethicone (trade name: "KF-6105", manufactured by Shin-Etsu Chemical Co., Ltd., the number of units in the formulas (1), (3) and (5) being 2 to 10, having a kinematic viscosity of 4000 $mm^2/s$ at 25° C.) was used as the polyether alkyl-modified silicone (b), and each oil agent composition was prepared with each composition ratio shown in Table 3.

Evaluation results of Examples b1 to b8 are shown in Table 3. In all of Examples b1 to b8, all of the evaluations of the bundling properties, the number of fusions, and the scattering of silicon compounds were satisfactory. In Example b8 in which the polyether alkyl co-modified silicone (b) was contained in an amount of 10 wt %, the bundling properties tended to be a little poorer than in other Examples, but it was not to a degree that would cause a problem in the production process.

In the evaluation results of the strand strength, all results were satisfactory, but a difference is caused by the difference in the components of the oil agent composition and the difference in the mixing ratio. In the case where the content of the polyether alkyl co-modified silicone (b) is 1 wt % (Example b5) or 10 wt % (Example b8), the strand strength was a little lower than in the case where the content is 3 wt % or 5 wt %, but it was a sufficient strength.

With respect to the aromatic ester, both the trimellitate and polyoxyethylene bisphenol A dilaurate showed satisfactory results, but the trimellitate was better.

With respect to the amino-modified silicone, satisfactory results were obtained in all cases where any of the primary side chain amino-modified type, the primary and secondary side chain amine-modified type, and the both-end amino-modified type was used. Best result was obtained when the primary side chain amino-modified type was used.

Comparative Examples b1 to b7

Comparative Examples b1 to b7 were performed in the same manner as in Comparative Examples a1 to a9 except that each oil agent composition was prepared with each composition ratio shown in Table 4. The results are shown in Table 4.

In Comparative Example b1, although the evaluation results of bundling properties and the scattering of silicon compounds were satisfactory, a large number of fusions were observed. As a result, it was expected that it would be difficult to continuously produce such a carbon fiber bundle industrially. Further, the strand strength was lower than that of the carbon fiber bundles in any of Examples 131 to b8.

There were a large number of fusions between single fibers in Comparative Example b2 in which the alkyl-modified silicone was used. Further, in the case where the content of the polyether alkyl co-modified silicone (b) exceeds 10 wt % (Comparative Examples b3 and b4), the bundling properties were low, which may have caused process failure. In addition, the strand strength in this case was lower than that in any of Examples b1 to b8.

In the case where the content of the trimellitate exceeds 50 wt % and the content of the amino-modified silicone is lower than 30 wt % (Comparative Example b4), it was impossible to completely prevent the fusion between single fibers, leading to reduction in strand strength. Further, in the case where the content of the trimellitate is lower than 30 wt % and the content of the amino-modified silicone exceeds 50 wt % (Comparative Example b3), the evaluation of the number of fusions and the evaluation results of the strand strength were relatively satisfactory, but the amount of scattered silicon compounds increased, leading to reduction in operability.

Note that, in the case where the polyether alkyl co-modified silicone (b) is not blended (Comparative Example b5), the strand strength was lower and the number of fusions was larger than those in the case where the polyether alkyl co-modified silicone (b) is blended in substantially the same composition (Example b1).

Further, in the case where the amino-modified silicone is used as the main component (Comparative Example b6), the amount of the scattering of silicon compounds was large, leading to reduction in operability; and in the case where the amino-modified silicone is not contained at all (Comparative Example b7), the number of fusions was high; the bundling properties were low; and the strand strength was low as well.

Examples c1 to c8

Examples c1 to c8 were performed in the same manner as in Examples a1 to a10 except that, as the polyether alkyl-modified silicone (c), there was used a modified silicone (trade name: "TSF4450", manufactured by Momentive Performance Materials Japan LLC, kinematic viscosity: 1000 $mm^2/s$ (25° C.)) having a random copolymer side chain of ethylene oxide and propylene oxide and an alkyl side chain in which the number of units of the Formulas (1) and (4) is 2 to 5, and each oil agent composition was prepared with each composition ratio shown in Table 5.

Evaluation results of Examples c1 to c8 are shown in Table 5. In all of Examples c1 to c8, all of the evaluations of the bundling properties, the number of fusions, and the scattering of silicon compounds were satisfactory. In Example c8 in which the polyether alkyl co-modified silicone (c) was contained in an amount of 10 wt %, the bundling properties were a little poorer than in other Examples, but it was not to a degree that would cause a problem in the production process.

In the evaluation results of the strand strength, all results were satisfactory, but a difference is caused by the difference in the components of the oil agent composition and the difference in the mixing ratio. In the case where the content of the polyether alkyl co-modified silicone (c) is 1 wt % (Example c5) or 10 wt % (Example c8), the strand strength was a little lower than in the case where the content is 3 wt % or 5 wt %, but it was a sufficient strength.

With respect to the aromatic ester, both the trimellitate and polyoxyethylene bisphenol A dilaurate showed satisfactory results, but the trimellitate was better.

With respect to the amino-modified silicone, satisfactory results were obtained in all cases where any of the primary side chain amino-modified type, the primary and secondary side chain amine-modified type, and the both-end amino-modified type was used. Best result was obtained when the primary side chain amino-modified type was used.

Comparative Examples c1 to c8

Comparative Examples c1 to c8 were performed in the same manner as in Comparative Examples a1 to a9 except that each oil agent composition was prepared with each composition ratio shown in Table 6. The results are shown in Table 6.

In Comparative Example c1, although the evaluation results of bundling properties and the scattering of silicon compounds were satisfactory, a large number of fusions were observed. As a result, it was expected that it would be difficult to continuously produce such a carbon fiber bundle industrially. Further, the strand strength was lower than that of the carbon fiber bundles in any of Examples c1 to c8.

There were a large number of fusions between single fibers in Comparative Example c2 in which the alkyl-modified silicone was used. Further, in the case where the content of the polyether alkyl co-modified silicone (c) exceeds 10 wt % (Comparative Examples c3 to c5), the bundling properties were low, which may have caused process failure.

In the case where the content of the trimellitate exceeds 50 wt % and the content of the amino-modified silicone was lower than 30 wt % (Comparative Example c4), it was impossible to completely prevent the fusion between single fibers, leading to reduction in strand strength. Further, in the case where the content of the trimellitate is lower than 30 wt % and the content of the amino-modified silicone exceeds 50 wt % (Comparative Example c3), the evaluation of the number of fusions and the evaluation results of the strand strength were relatively satisfactory, but the amount of scattered silicon compounds increased, leading to reduction in operability.

Note that, in the case where the polyether alkyl co-modified silicone (c) is not blended (Comparative Example c6), the number of fusions was larger and the strand strength was lower than those in the case where the polyether alkyl co-modified silicone (c) is blended in substantially the same composition (Example c1).

Further, in the case where the amino-modified silicone is used as the main component (Comparative Example c7), the amount of the scattering of silicon compounds was large, leading to reduction in operability; and in the case where the amino-modified silicone is not contained at all (Comparative Example c8), the number of fusions was high; the bundling properties were low; and the strand strength was low as well.

TABLE 1

| | | | Example | | | | | | | | | |
|---|---|---|---|---|---|---|---|---|---|---|---|---|
| | | | a1 | a2 | a3 | a4 | a5 | a6 | a7 | a8 | a9 | a10 |
| Oil agent composition (wt %) | Polyether alkyl co-modified silicone (a) | | 5 | 5 | 5 | 5 | 1 | 3 | 5 | 10 | 3 | 3 |
| | Aromatic ester | (i) | 40 | | 40 | 40 | 50 | 40 | 30 | 40 | 57 | 67 |
| | | (ii) | | 40 | | | | | | | | |
| | Amino-modified silicone | (1) | 35 | 35 | | | 39 | 37 | 50 | 30 | 20 | 10 |
| | | (2) | | | 35 | | | | | | | |
| | | (3) | | | | 35 | | | | | | |
| | PO-EO copolymer | | 20 | 20 | 20 | 20 | 10 | 20 | 15 | 20 | 20 | 20 |
| Evaluations | Amount of adhered oil agent (wt %) | | 1.02 | 1.18 | 0.94 | 1.05 | 0.98 | 1.07 | 1.12 | 1.15 | 1.13 | 1.20 |
| | Bundling properties | | ○ | ○ | ○ | ○ | ○ | ○ | ○ | Δ | Δ | Δ |
| | Number of fusions | | ○ | ○ | ○ | ○ | ○ | ○ | ○ | ○ | ○ | ○ |
| | Amount of scattered Si (mg/kg) | | 383 | 408 | 395 | 416 | 420 | 402 | 482 | 457 | 380 | 322 |
| | CF strength (MPa) | | 5520 | 5380 | 5310 | 5340 | 5230 | 5490 | 5430 | 5280 | 5210 | 5130 |

TABLE 2

| | | | Comparative Example | | | | | | | | |
|---|---|---|---|---|---|---|---|---|---|---|---|
| | | | a1 | a2 | a3 | a4 | a5 | a6 | a7 | a8 | a9 |
| Oil agent composition (wt %) | Polyether-modified silicone | | 5 | | | | | | | | |
| | Alkyl-modified silicone | | | 5 | | | | | | | |
| | Polyether alkyl co-modified silicone (a) | | | | 15 | 15 | 15 | 20 | | | |
| | Aromatic ester | (i) | 40 | 40 | 15 | 35 | 60 | 35 | 40 | | 80 |
| | Amino-modified silicone | (1) | 35 | 35 | 60 | 35 | 15 | 35 | 40 | 80 | |
| | PO-EO copolymer | | 20 | 20 | 10 | 15 | 10 | 10 | 20 | 20 | 20 |
| Evaluations | Amount of adhered oil agent (wt %) | | 1.05 | 1.20 | 0.93 | 0.94 | 1.23 | 0.95 | 1.35 | 1.10 | 1.23 |
| | Bundling properties | | ○ | ○ | Δ | X | Δ | X | ○ | ○ | X |
| | Number of fusions | | X | X | ○ | X | X | X | X | ○ | X |
| | Amount of scattered Si (mg/kg) | | 482 | 499 | 863 | 524 | 402 | 683 | 466 | 912 | 0 |
| | CF strength (MPa) | | 4980 | 5130 | 5210 | 4950 | 4800 | 4850 | 5040 | 5460 | 3810 |

TABLE 3

| | | | Example | | | | | | | |
|---|---|---|---|---|---|---|---|---|---|---|
| | | | b1 | b2 | b3 | b4 | b5 | b6 | b7 | b8 |
| Oil agent composition (wt %) | Polyether alkyl co-modified silicone (b) | | 5 | 5 | 5 | 5 | 1 | 3 | 5 | 10 |
| | Aromatic ester | (i) | 40 | | 40 | 40 | 50 | 40 | 30 | 40 |
| | | (ii) | | 40 | | | | | | |
| | Amino-modified silicone | (1) | 35 | 35 | | | 39 | 37 | 50 | 30 |
| | | (2) | | | 35 | | | | | |
| | | (3) | | | | 35 | | | | |
| | PO-EO copolymer | | 20 | 20 | 20 | 20 | 10 | 20 | 15 | 20 |
| Evaluations | Amount of adhered oil agent (wt %) | | 0.87 | 1.22 | 1.14 | 0.98 | 1.32 | 1.01 | 0.93 | 1.05 |
| | Bundling properties | | ○ | ○ | ○ | ○ | ○ | ○ | ○ | Δ |
| | Number of fusions | | ○ | ○ | ○ | ○ | ○ | ○ | ○ | ○ |
| | Amount of scattered Si (mg/kg) | | 423 | 446 | 436 | 459 | 455 | 445 | 521 | 498 |
| | CF strength (MPa) | | 5410 | 5280 | 5210 | 5220 | 5120 | 5380 | 5330 | 5190 |

TABLE 4

| | | | Comparative Example | | | | | | |
|---|---|---|---|---|---|---|---|---|---|
| | | | b1 | b2 | b3 | b4 | b5 | b6 | b7 |
| Oil agent composition (wt %) | Polyether-modified silicone | | 5 | | | | | | |
| | Alkyl-modified silicone | | | 5 | | | | | |
| | Polyether alkyl co-modified silicone (b) | | | | 15 | 15 | | | |
| | Aromatic ester | (i) | 40 | 40 | 15 | 60 | 40 | | 80 |
| | Amino-modified silicone | (1) | 35 | 35 | 60 | 15 | 40 | 80 | |
| | PO-EO copolymer | | 20 | 20 | 10 | 10 | 20 | 20 | 20 |
| Evaluations | Amount of adhered oil agent (wt %) | | 1.05 | 1.20 | 1.13 | 1.09 | 1.35 | 1.10 | 1.23 |
| | Bundling properties | | ○ | ○ | Δ | Δ | ○ | ○ | X |
| | Number of fusions | | X | X | ○ | X | X | ○ | X |
| | Amount of scattered Si (mg/kg) | | 482 | 499 | 905 | 409 | 466 | 912 | 0 |
| | CF strength (MPa) | | 4980 | 5130 | 5090 | 4830 | 5040 | 5460 | 3810 |

TABLE 5

| | | | Example | | | | | | | |
|---|---|---|---|---|---|---|---|---|---|---|
| | | | c1 | c2 | c3 | c4 | c5 | c6 | c7 | c8 |
| Oil agent composition (wt %) | Polyether alkyl co-modified silicone (c) | | 5 | 5 | 5 | 5 | 1 | 3 | 5 | 10 |
| | Aromatic ester | (i) | 40 | | 40 | 40 | 50 | 40 | 30 | 40 |
| | | (ii) | | 40 | | | | | | |
| | Amino-modified silicone | (1) | 35 | 35 | | | 39 | 37 | 50 | 30 |
| | | (2) | | | 35 | | | | | |
| | | (3) | | | | 35 | | | | |
| | PO-EO copolymer | | 20 | 20 | 20 | 20 | 10 | 20 | 15 | 20 |

TABLE 5-continued

| | | Example | | | | | | | |
|---|---|---|---|---|---|---|---|---|---|
| | | c1 | c2 | c3 | c4 | c5 | c6 | c7 | c8 |
| Evaluations | Amount of adhered oil agent (wt %) | 1.24 | 1.32 | 0.85 | 0.94 | 1.21 | 1.14 | 1.08 | 0.80 |
| | Bundling properties | ○ | ○ | ○ | ○ | ○ | ○ | ○ | Δ |
| | Number of fusions | ○ | ○ | ○ | ○ | ○ | ○ | ○ | ○ |
| | Amount of scattered Si (mg/kg) | 455 | 475 | 461 | 488 | 491 | 474 | 552 | 530 |
| | CF strength (MPa) | 5350 | 5220 | 5140 | 5170 | 5060 | 5330 | 5270 | 5110 |

TABLE 6

| | | Comparative Example | | | | | | | |
|---|---|---|---|---|---|---|---|---|---|
| | | c1 | c2 | c3 | c4 | c5 | c6 | c7 | c8 |
| Oil agent composition (wt %) | Polyether-modified silicone | 5 | | | | | | | |
| | Alkyl-modified silicone | | 5 | | | | | | |
| | Polyether alkyl co-modified silicone (c) | | | 15 | 15 | 20 | | | |
| | Aromatic ester (i) | 40 | 40 | 15 | 60 | 35 | 40 | | 80 |
| | Amino-modified silicone (1) | 35 | 35 | 60 | 15 | 35 | 40 | 80 | |
| | PO-EO copolymer | 20 | 20 | 10 | 10 | 10 | 20 | 20 | 20 |
| Evaluations | Amount of adhered oil agent (wt %) | 1.05 | 1.20 | 1.32 | 1.16 | 1.02 | 1.35 | 1.10 | 1.23 |
| | Bundling properties | ○ | ○ | Δ | Δ | X | ○ | ○ | X |
| | Number of fusions | X | X | ○ | X | X | X | ○ | X |
| | Amount of scattered Si (mg/kg) | 482 | 499 | 935 | 471 | 757 | 466 | 912 | 0 |
| | CF strength (MPa) | 4980 | 5130 | 5040 | 4640 | 5040 | 5040 | 5460 | 3810 |

This application claims priority on the basis of Japanese patent application No. 2007-289409 filed on Nov. 7, 2007, Japanese patent application No. 2007-318440 filed on Dec. 10, 2007, and Japanese patent application No. 2007-318439 filed on Dec. 10, 2007, the disclosure of which are herein incorporated by reference in their entirety.

Hereinbefore, the present invention has been described with reference to the exemplary embodiments (and Examples), but the present invention is not limited to the exemplary embodiments (and Examples) as described above. Various modifications which those skilled in the art can understand can be made to the constitution and details of the present invention within the scope of the present invention.

Industrial Applicability

According to the present invention, there is prepared an oil agent composition in which a silicone compound and a non-silicone compound are compatibilized by using a specific modified polydimethylsiloxane. This oil agent composition effectively suppresses the fusion between single fibers in a heating step, can suppress the reduction in operability occurring when using an oil agent composition in which a silicone compound is used as the main component, and provides a carbon fiber bundle having high mechanical strength. That is, the present invention can provide an oil agent composition for acrylic precursor fibers for carbon fibers which can improve both the performance and the operation stability of a carbon fiber bundle.

The carbon fiber bundle obtained from the precursor fiber bundle to which this oil agent composition for acrylic precursor fibers for carbon fibers is properly applied can be formed into a prepreg, which can then be molded into a composite material. The carbon fiber bundle can be suitably used as a useful material in applications such as sporting applications such as a golf shaft and a fishing rod, motor vehicle and aerospace applications as a structural material, and various gas storage tank applications.

The invention claimed is:

1. A composition comprising 1 to 10 wt % of a modified polydimethylsiloxane, 30 to 70 wt % of an aromatic ester, 10 to 50 wt % of an amino-modified silicone, and 10 to 40 wt % of a nonionic emulsifier, wherein said modified polydimethylsiloxane comprises:

units represented by each of the formulas (1), (3) and (5) below in an amount of 1 to 20 and has a kinematic viscosity at 25° C. of 3000 to 5000 $mm^2/s$; or units represented by each of the formulas (1) and (4) below in an amount of 1 to 20 and has a kinematic viscosity at 25° C. of 500 to 1500 $mm^2/s$:

(1)

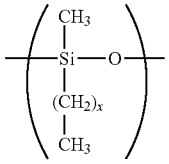

wherein x is 7 to 15, (3)

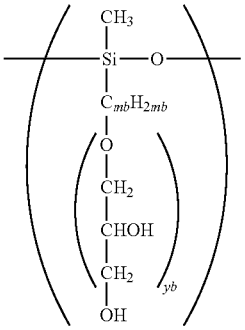

wherein mb is 0 to 3; and yb is 1 to 5, (4)

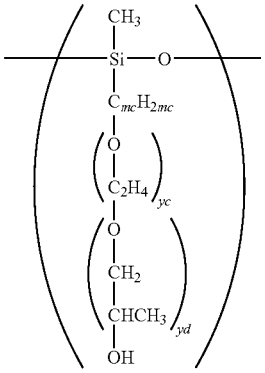

wherein yc +yd is 5 to 15; ethylene oxide and propylene oxide each is a block copolymer or a random copolymer; and mc is 0 to 3,

[Formula 5]

(5)

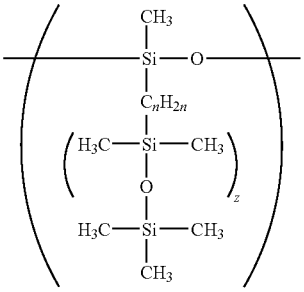

wherein n is 1 to 5; and z is 3 to 60.

2. The composition according to claim 1, wherein the modified polydimethylsiloxane comprises units represented by each of the formulas (1), (3) and (5) in an amount of 1 to 20 and has a kinematic viscosity at 25° C. of 3000 to 5000 $mm^2/s$.

3. The composition according to claim 2, comprising 3 to 5 wt % of said modified polydimethylsiloxane, 30 to 40 wt % of said aromatic ester, 30 to 40 wt % of said amino-modified silicone, and 10 to 20 wt % of said nonionic emulsifier.

4. An acrylic precursor fiber bundle having, thereon, the composition according to claim 3 in an amount of 0.1 to 2.0 wt % based on the mass of dry fiber.

5. The composition according to claim 1, wherein the modified polydimethylsiloxane comprises units represented by each of the formulas (1) and (4) in an amount of 1 to 20 and has a kinematic viscosity at 25° C. of 500 to 1500 mm2/s.

6. The composition according to claim 5, comprising 3 to 5 wt % of said modified polydimethylsiloxane, 30 to 40 wt % of said aromatic ester, 30 to 40 wt % of said amino-modified silicone, and 10 to 20 wt % of said nonionic emulsifier.

7. An acrylic precursor fiber bundle having, thereon, the composition according to claim 6 in an amount of 0.1 to 2.0 wt % based on the mass of dry fiber.

8. The composition according to claim 1, comprising 30 to 40 wt % of an aromatic ester and 30 to 40 wt % of an amino-modified silicone.

9. The composition according to claim 1, comprising 10 to 20 wt % of a nonionic emulsifier.

10. An oil agent prepared by dispersing the composition according to claim 1 in water.

11. An acrylic precursor fiber bundle having, thereon, an oil agent according to claim 10 in an amount of 0.1 to 2.0 wt % based on the mass of dry fiber.

12. An acrylic precursor fiber bundle having, thereon, the composition according to claim 1 in an amount of 0.1 to 2.0 wt % based on the mass of dry fiber.

13. The composition according to clam 1, wherein said composition is located on an acrylic precursor fiber.

14. The composition according to claim 1, comprising 3 to 5 wt % of said modified polydimethylsiloxane, 30 to 40 wt % of said aromatic ester, 30 to 40 wt % of said amino-modified silicone, and 10 to 20 wt % of said nonionic emulsifier.

15. An acrylic precursor fiber bundle having, thereon, the composition according to claim 14 in an amount of 0.1 to 2.0 wt % based on the mass of dry fiber.

16. A composition comprising 1 to 10 wt % of a modified polydimethylsiloxane, 30 to 70 wt % of an aromatic ester, 10 to 50 wt % of an amino-modified silicone, and 10 to 40 wt % of a nonionic emulsifier, wherein the modified polydimethylsiloxane comprises units represented by each of formulas (1), (2) and (5) below in an amount of one or more and has a kinematic viscosity at 25° C. of 500 to 1000 $mm^2/s$:

(1)

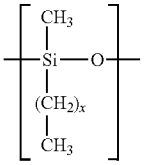

wherein x is 7 to 15, (2)

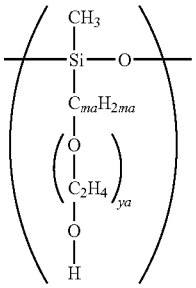

wherein ma is 0; and ya is 1 to 15,

[Formula 5]

(5)

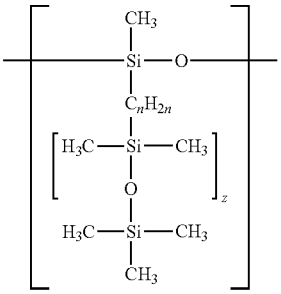

wherein n is 1 to 5; and z is 3 to 60.

17. The composition according to claim 16, comprising 3 to 5 wt % of said modified polydimethylsiloxane, 30 to 40 wt % of said aromatic ester, 30 to 40 wt % of said amino-modified silicone, and 10 to 20 wt % of said nonionic emulsifier.

18. An acrylic precursor fiber bundle having, thereon, the composition according to claim 17 in an amount of 0.1 to 2.0 wt % based on the mass of dry fiber.

* * * * *